US006548008B1

(12) United States Patent
Kuriyama et al.

(10) Patent No.: US 6,548,008 B1
(45) Date of Patent: Apr. 15, 2003

(54) METHOD FOR BENDING SI MATERIALS AND CORE WIRE MEMBER OF SI MATERIALS

(75) Inventors: Kazuya Kuriyama, Osaka (JP); Takayuki Furukoshi, Osaka (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/323,781

(22) Filed: Jun. 1, 1999

(30) Foreign Application Priority Data

Jun. 1, 1998 (JP) ..... 10-169234

(51) Int. Cl.[7] ..... B29C 53/08; B29C 53/84

(52) U.S. Cl. ..... 264/322; 264/339

(58) Field of Search ..... 264/322, 339

(56) References Cited

U.S. PATENT DOCUMENTS 4,073,859 A * 2/1978 Baumgartner et al. ..... 264/322

OTHER PUBLICATIONS

J.R. Petel and A.R. Chaudhuri, "Macroscopic Plastic Properties of Dislocation–Free Germanium and Other Semiconductor Crystals. I. Yield Behavior", J. Appl. Phys., 34(9), pp. 2788–2799. Sep., 1963.

* cited by examiner

*Primary Examiner*—Leo B. Tentoni
(74) *Attorney, Agent, or Firm*—Darby & Darby

(57) ABSTRACT

Si material, which has been considered to be very brittle, and hard to bend, is heated to at least its brittle-ductile transition temperature. A bending moment is applied to a heated portion of the Si material so that a slip deformation is generated. Whereby it is possible to perform bending, and to greatly improve a degree of freedom for machining the Si material. The Si material has a brittle-ductile transition temperature which transfers from a brittle to a ductile state at its brittle-ductile transition temperature. At the transition temperature or more, the Si material is in a state that a slip can to be generated between its crystals in response to a bending torque applied thereto. Thus, when a bending moment is applied to the heated portion of the Si material which is heated to the transition temperature or more, a slip is generated between lattices or between crystal grains in the heated portion, so that the Si material is deformed.

12 Claims, 8 Drawing Sheets

BREAKING TEST RESULTS FOR Si MATERIAL

FIG. 6
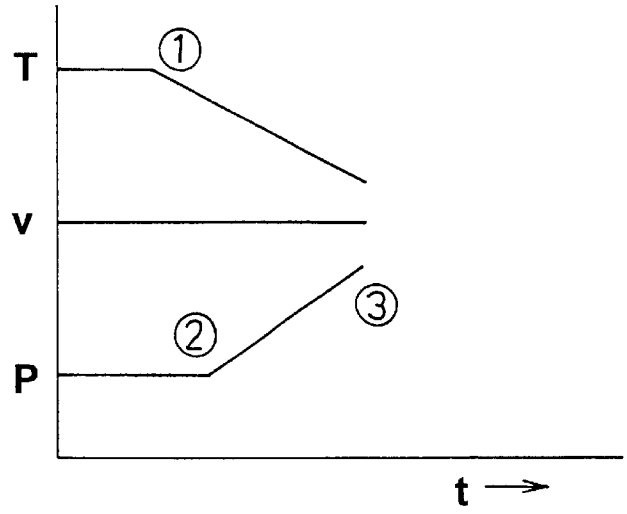
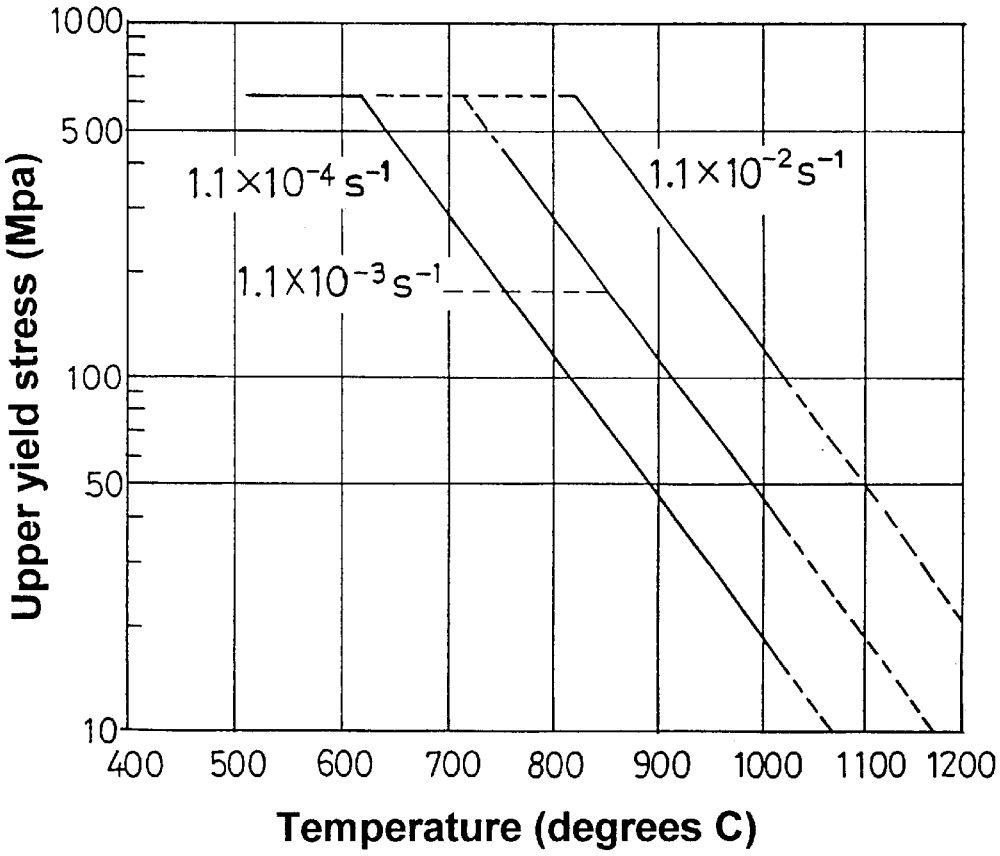
FIG. 7

METHOD FOR BENDING SI MATERIALS AND CORE WIRE MEMBER OF SI MATERIALS

BACKGROUND OF THE INVENTION

1. Field of the Invention

The present invention relates to a method for bending Si material that can produce a high-accuracy bend in a single crystal or polycrystal silicon (hereinafter, referred simply to as "Si material") without contamination of the Si material. The present invention also relates to a core wire member made of Si material for manufacturing a polycrystal Si.

2. Description of the Related Art

In recent years, silicon (Si) has shown a remarkable growth in demand for a semiconductor material. The physical and electrical characteristics of this material as a semiconductor are noticed. In particular, Si used as a bulk material has been frequently used as a substrate for a DRAM (Direct Random Access Memory) and for an MPU (Micro Processor Unit). In addition, Si material is in great demand for wafers. Recently, wafers are being made in larger diameters. This requires that the Si ingots, from which the wafers are sliced, also has grown proportionately. Si ingots now weigh 200 kg or more. The large size and great weight are producing problems in holding and carrying the Si ingot. More specifically, in order to prevent metal contamination of the Si ingot, Si and other materials are frequently used in handling jigs and other manufacturing tools. However, as the weight and diameter of the Si ingot increase, the difficulty in manufacturing such jigs increases.

One approach to solving this problem is machining the Si ingot itself to make it easier to attach jigs for carrying. However, the brittleness of Si material makes it difficult to machine, and also, post-process washing or the like is required. For this reason, according to the aforesaid course, new problems arise such as higher cost and complication of the manufacturing process.

Moreover, in order to produce functioning semiconductors such as, for example, integrated circuits on a silicon wafer, heat treatment at high temperature and film forming are carried out in batch processing. Conventionally, a wafer holding jig used in this case is mainly quartz. Quartz is not ideal since it has different thermal characteristics from the Si material of the wafer, especially at large diameter. For this reason, a single crystal silicon board has been often used for the holding jig because single crystal silicon has the same characteristic as the wafer. Therefore, single crystal silicon is effective in decreasing contamination of the wafer. However, such a board is manufactured by cutting it from a single crystal silicon ingot. This makes such boards expensive in view of the poor mechanical workability of the material. Thus, there is a need for a method for freely bending these components so as to reduce or eliminate the need for machining.

Si is a very brittle material. For this reason, Si is fractured (destroyed) by impact when a great force is applied thereto at ordinary (room) temperature. Moreover, Si material has high strength at high temperature. For these reasons, it has been considered impossible to carry out plastic forming of Si material. In the case of compressive deformation restraining slip deformation, Si is not deformed until just as it reaches its melting point. At its melting point the material is in a transition state between rigidity and being melted. For this reason, it has been considered impossible to bend Si material.

OBJECTS AND SUMMARY OF THE INVENTION.

It is an object of the present invention to provide a bending method for Si material which overcomes the drawbacks of the prior art.

The inventors have achieved the present invention on the basis of the fact that, when a bending moment is applied to a heated portion of Si material heated to a brittle-ductile transition temperature or above, slip deformation is generated. Such slip deformation makes it possible to bend the Si material without contaminating the Si material.

Briefly stated, the present invention provides a method for bending Si material, which have been considered to be very brittle, and hard to bend. The Si material is heated to at least its brittle-ductile transition temperature. A bending moment is applied to a heated portion of the Si material so that a slip deformation is generated. Whereby it is possible to perform bending, and to greatly improve a degree of freedom from machining the Si material. The Si material has a brittle-ductile transition temperature which transfers from a brittle to a ductile state at its brittle-ductile transition temperature. At the transition temperature or more, the Si material is in a state that a slip can to be generated between its crystals in response to a bending torque applied thereto. Thus, when a bending moment is applied to the heated portion of the Si material which is heated to the transition temperature or more, a slip is generated between lattices or between crystal grains in the heated portion, so that the Si material is deformed.

According to an embodiment of the invention, there is provided a bending method for Si material, comprising the following steps of: heating an Si material to at least a brittle-ductile transition temperature to produce a heated portion, and applying a bending moment to said heated portion to produce a slip deformation in said Si material.

According to a feature of the invention, there is provided apparatus for bending a Si material comprising: a rotatable arm, said rotatable arm being rotatable about an axis, a holding portion effective for clamping said Si material, means for applying a thrust to said Si material toward said rotatable arm, whereby said Si material is urged toward said rotatable arm, and said rotatable arm applies a bending moment to said Si material, means for heating said Si material upstream of said holding portion, and said means for applying a thrust including a fluid cylinder having a substantially constant flow rate of fluid fed thereto.

According to a further feature of the invention, there is provided a core wire member made of Si material comprising: first and second core wire portions extending substantially parallel with each other, a connective portion, a first junction connecting a first end of said first core wire portion to a first end of said connective portion, a second junction connecting a first end of said second core wire portion to a second end of said connective portion, and said first and second junctions being formed by bending.

According to a still further feature of the invention, there is provided apparatus for bending an Si material comprising: first means for applying a bending torque to said Si material, second means for applying a longitudinal force to said Si material toward said first means, means for locally heating said Si material between said first and second means, said second means being responsive to a reduction in temperature of said Si material to slow down an advance of said Si material, and responsive to an increase in temperature of said Si material, whereby negative feedback stabilizes bending of said Si material.

More specifically, according to the present invention, the Si material, which have been considered to be very brittle and hard to bend, is heated to a brittle-ductile transition temperature or above, a bending moment is applied to a heated portion of the Si material to generate a slip deformation. This technique permits bending Si material. Thus, it is possible to manufacture a member made of Si material, which has been conventionally manufactured only by machining. Further, it is possible to manufacture a member having a shape which is hard to be manufactured by machining, and thus, the need for machining the Si material is reduced or eliminated.

Referring to FIG. 10, a core wire member made of Si material is treated to deposit a polycrystal Si on its surface. Core wire members are arranged in a bell jar into which a silicon-bearing gas such as monosilane or trichlorosilane is introduced. Polycrystal silicon is grown on a surface of the core wire member while it is heated. This technique has the following draw backs. Conventionally, in a core wire member made of Si material for manufacturing a polycrystal Si, the following connection structure has been employed. More specifically, in each junction 33 extending from the core wire portion 31 to the connective portion 32, a rod-like core wire portion 31 and a rod-like connective portion 32, which are arranged perpendicular to each other, are mechanically connected by concavity convexity fitting or the like. In the conventional connection structure, while energizing and heating the core wire member so that the polycrystal silicon is grown on its surface, an abnormal growth of the polycrystal Si occurs at the junction 33 resulting from the following reasons. First of all, contact resistance is high in the junction 33 thereby elevating the temperature of the junction. As a result, this causes a localized abnormal growth of the polycrystal Si. Secondly, at areas where inner side portion of two rod-like members 31, 32 cross perpendicular to each other, the radiant heat from each mutually interacts with the radiant heat from the other. This elevates the temperature of the inner side portions. As a result, abnormal growth of polycrystal Si occurs in these areas.

Referring now to FIG. 11, as described above, when abnormal growth of the polycrystal Si happens in the junction 33, in the case of divisively removing the rod-like polycrystal Si, there are the following disadvantages. More specifically, in the vicinity of the junction 33 the rod-like polycrystal Si does not clearly crack in a direction perpendicular to an axial direction thereto, but instead, cracks in a slanting direction. As a result, the manufacturing yield of rod-like polycrystal Si is reduced.

Therefore, in the present invention, when bending the core wire member for growing the polycrystal Si, abnormal growth of the polycrystal Si is reduced, so that bending and cracking the rod-like polycrystal Si is readily carried out. As a result, the manufacturing yield of the rod-like polycrystal Si is improved.

To achieve the above object, the present invention provides a bending method for Si material, comprising the steps of: heating an Si material 1 having brittleness at room temperature to a brittle-ductile transition temperature or higher; and applying a bending moment to the heated portion of the Si material so that slip deformation is generated in the Si material 1.

Referring now to FIG. 1, a graph shows a relationship between the heating temperature in Si material and a plastic strain generated at break under the heating temperature. The Si-material has almost no plastic strain until the heating temperature reaches the vicinity of 700° C. However, when the heating temperature exceeds 700° C., plastic strain resulting from slip is gradually generated in the Si material. Then, at a temperature of 800° C. or more, the plastic strain suddenly increases. More specifically, the Si material has a brittle-ductile transition temperature which transfers from a brittle state to a ductile state. At the aforesaid brittle-ductile transition temperature or more, the Si material is in a state permitting crystal slip to occur. Thus, when a bending moment is applied to the heated portion heated to the aforesaid brittle-ductile transition temperature or more, slip is generated between atoms or between crystal grains in the heated portion. As a result, the Si material is deformed. In this case, a heating source is not specially limited, and may use a gas, high frequency and radiant heat using high frequency or the like.

As is evident from the above description, it is possible to manufacture a member made of Si material, which has been conventionally manufactured only by machining, and further, it is possible to manufacture a member having a shape which is hard to manufacture by machining. Thus, a degree of freedom for machining the Si material is greatly improved.

Further, the present invention provides a bending method for Si material wherein a rotatable arm 5, supported for rotation around a specified shaft 5*a*, is provided with a holding portion 5*b*. A feeder mechanism 3 for feeding a rod-like Si material 1 is arranged so that the rod-like Si material 1 runs along a circular-arc orbit of the holding portion 5*b*. With the rod-like Si material 1 held by the holding portion 5*b*, a bending moment is applied to the fed rod-like Si material 1 by longitudinal feeding of the rod-like Si material 1 and by rotation of the rotatable arm 5.

According to the bending method for Si material, a rod-like Si material 1 is fed by a feeder mechanism 3 while being held by a holding portion 5*b*. A bending moment is continuously applied to the Si material 1 by longitudinal feed of the feeder mechanism 3 and by rotation of the rotatable arm 5. The Si material 1 is locally heated in this condition to a temperature where it exhibits plasticity. Slip deformation is generated in the heated portion to which a bending moment is applied. As a result, a bend is generated in the Si material. Thus, it is possible to carry out so-called continuous dieless bending without the use of molding dies, and to bend the rod-like Si material 1 into a smoothly circular-arc shape. Since no molding dies are used, the heated portion of the Si material does not contact the surface of molding dies. This permits carrying out bending while reducing contamination such as metal pollution and oxidation. In order to feed the Si material 1, a thrust force (propulsion) may be applied to the Si material 1 from the feeder mechanism 3 or a pressure cylinder of a driving system 2, or a traction force may be applied to the Si material 1 from the rotatable arm 5.

Further, the present invention provides a bending method for Si material, wherein rod-like Si material 1 is locally heated just downstream of the feeding location, and thereby, a heated region of the rod-like Si material 1 is successively moved along the rod-like Si material 1.

According to the bending method for Si material, a gentle temperature distribution is given to the Si material 1. Therefore, by carrying out the aforesaid continuous dieless bending, the Si material 1 is deformed while absorbing heat. Then, the deformed portion is gradually enlarged, and thus, a predetermined bending portion is realized. Whereby preferable bending is performed.

The present invention provides a bending method for Si material wherein; a rotatable arm 5 is supported for rotation around a shaft 5*a*. The rotatable arm includes a holding portion 5*b*. A fluid pressure cylinder 2 for feeding a rod-like Si material 1 while applying a thrust force (propulsion) to the Si material 1 is arranged so that its feeding direction runs tangent to a circular-arc orbit of the holding portion 5*b*. While the rod-like Si material 1 is held by the holding portion 5*b*, a bending moment is applied to the fed rod-like Si material 1 by a feed of the rod-like Si material 1 and by a rotation of the rotatable arm 5. The flow rate of fluid fed to the pressure cylinder 2 is maintained approximately constant. Heating is performed locally at a location where the rod-like Si material 1 thus fed runs on a circular-arc orbit of the holding portion 5*b*, or in a neighborhood position.

According to the bending method for Si of materials, since a thrust force (propulsion) of a pressure cylinder 2 is maintained by controlling the fluid flow rate to its pressure cylinder to be approximately constant, bending deformation is generated in a state that a temperature change of the heated portion of the Si material 1 and a feed speed of the Si material 1 are well-matched. That is, bending proceeds under an operating condition of, so to speak, a self-regulation operation as described below:

1) a temperature change causes a deformation resistance change;
2) the deformation resistance change brings about a bending deformation quantity change;
3) the change in the bending deformation quantity changes the feed speed;
4) the change in the feed speed again produces a temperature change.

The self-regulation in the foregoing produces stable bending.

Further, the present invention provides a bending method for Si material wherein the holding portion 5*b* of the rotatable arm 5 is made of the same material as the rod-like Si material 1 or of a material having a hardness greater than that of the rod-like Si material 1.

According to the bending method for Si material, bending can be carried out while limiting contamination such as metal pollution and oxidation.

If the heating temperature of the aforesaid Si material 1 is set 900° C. or more, preferable bending is achieved. In view of limiting contamination, it is preferable that the heating temperature of the Si material 1 is set to 1300° C. or below.

A core wire member made of Si material, which is arranged in a bell jar into which a silicon-bearing gas such as monosilane and trichlorosilane is introduced, and is used so that polycrystal silicon is grown on a surface of the core wire member when being heated, comprising: a pair of core wire portions 21, 21 extending substantially parallel with each other; and a connective portion 22 connecting one end side of the core wire portions 21, 21 to each other, each junction 23 extending from the core wire portion 21 to the connective portion 22 being formed by being subjected to bending.

The core wire member made of Si material is bent by the following steps of: heating a Si material 1 having a brittleness at a room temperature to a brittle-ductile transition temperature or more; and applying a bending moment to a heated portion of the Si material 1 so that a slip deformation is generated in the Si material 1.

On the contrary, in the core wire member for growing the polycrystal Si, each junction 23 extending from the core wire portion 21 to the connective portion 22 is formed by being subjecting to bending. Thus, in the junction 23, the aforesaid abnormal growth of the polycrystal Si is reduced, so that the work of bending and cracking the rod-like polycrystal Si is readily carried out. As a result, it is possible to improve the manufacturing yield of the rod-like polycrystal Si.

BRIEF DESCRIPTION OF THE DRAWINGS

FIG. 6 is a time chart showing elapsed changes of a temperature T of the heated portion in a bending operation of Si material, a feed speed V of the rod-like Si material 1, and an internal fluid pressure P of a hydraulic cylinder 2 wherein the fluid flow rate is held constant.

FIG. 7 is a graph showing a temperature dependence of a yield stress of the Si material in relation to a strain velocity.

DETAILED DESCRIPTION OF THE PREFERRED EMBODIMENTS

Figure 1:
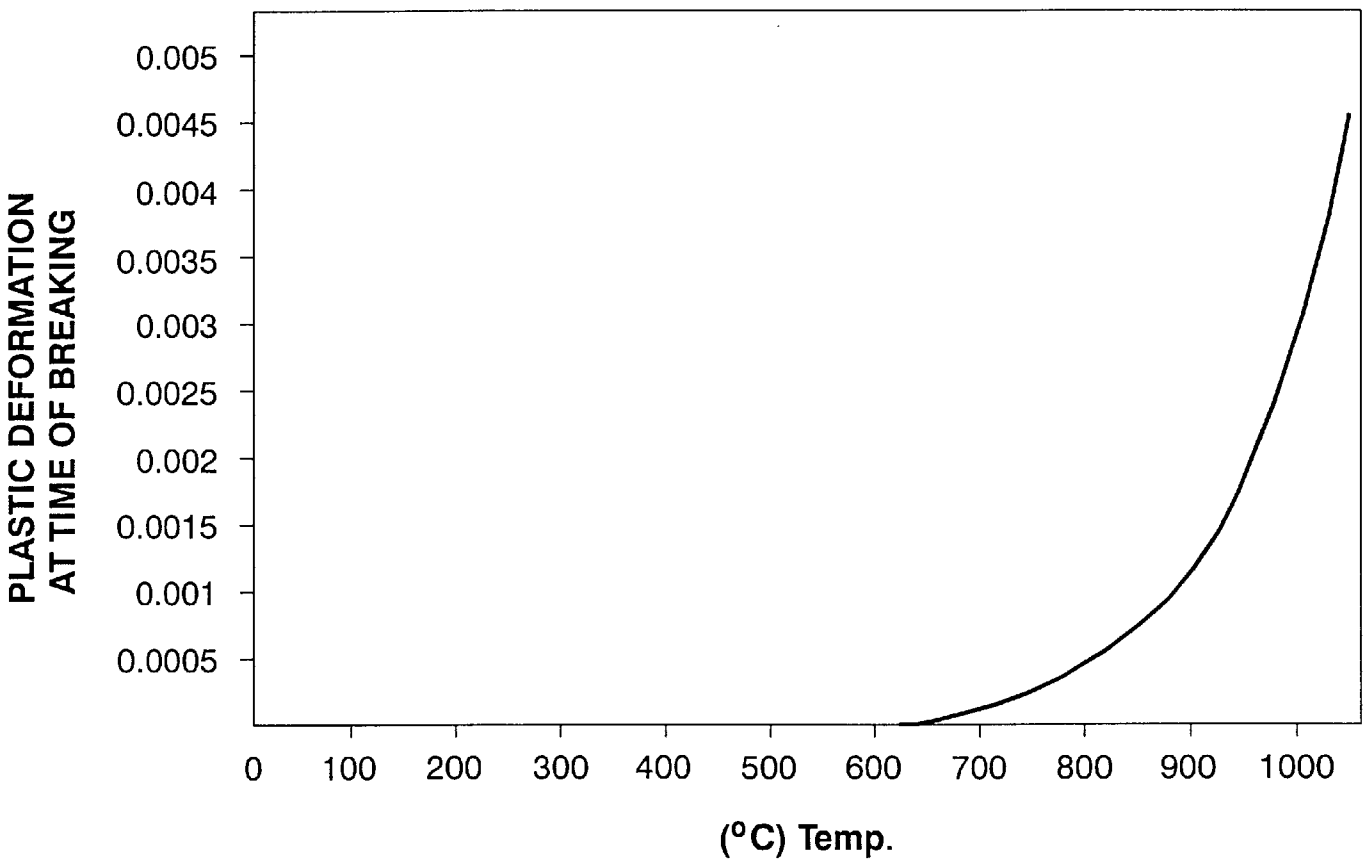
FIG. 1 is a graph showing a breaking test result of Si material under a heating condition.
Figure 2:
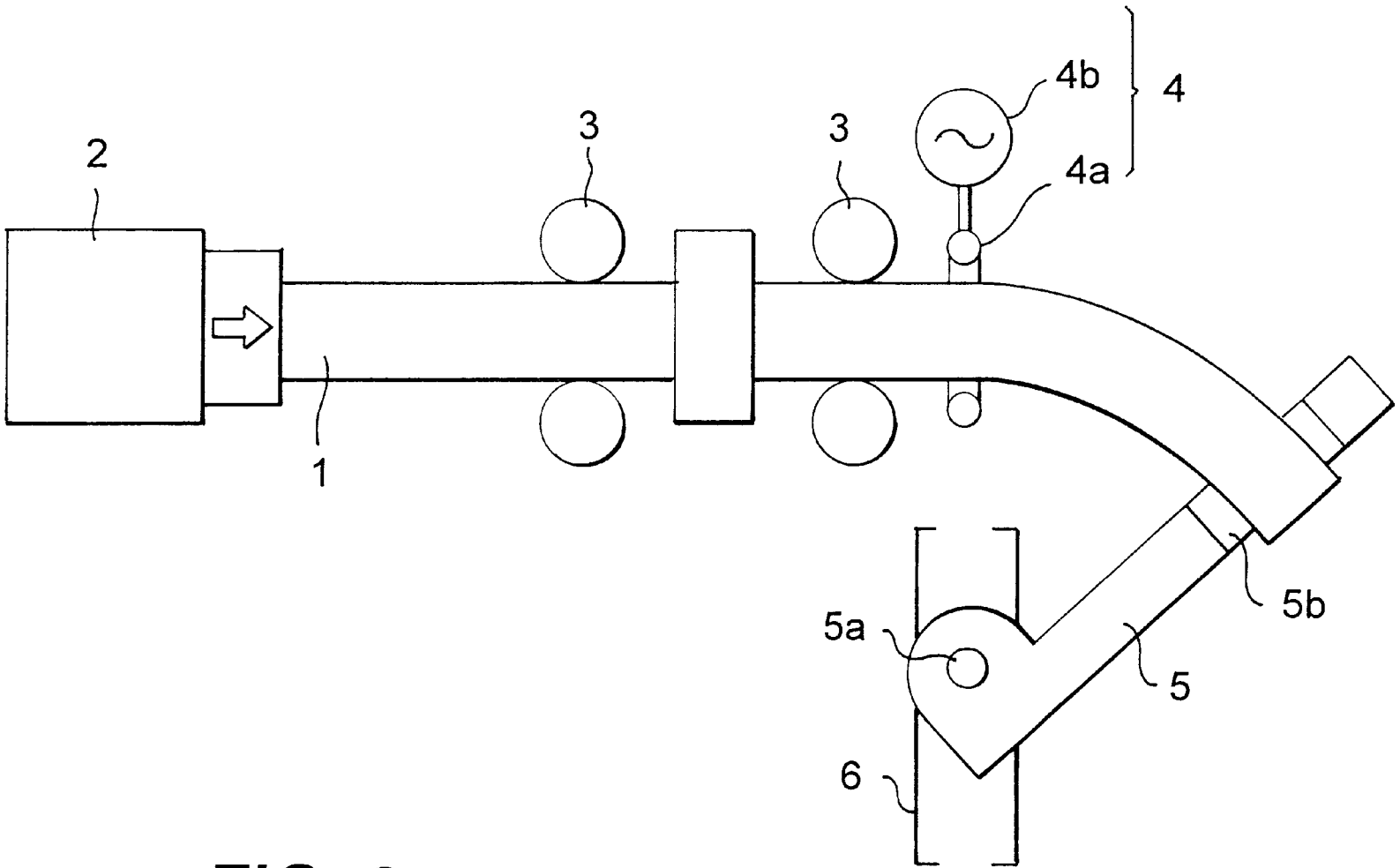
FIG. 2 is a view schematically showing a machining system for carrying out a bending method of the present invention.

Referring to FIG. 2, a thrust force (propulsion) is applied in an axial direction to a rod-like Si material 1 by a driving system 2. The driving system 2 includes, e.g., an air cylinder and a guide roller group 3. The Si material is fed in a predetermined direction by the guide roller group 3 which functions as a feeder mechanism. A heater 4 is arranged in the vicinity of the guide roller group 3 at an upstream (front) side of a traveling direction of the Si material 1. The heater 4 includes a heating coil 4*a* and a high frequency generator 4*b*. When the Si material 1 passes through the heating coil 4*a*, a high frequency current flows into the heating coil 4*a* from a high frequency generator 4*b*. An induced current flows in the Si material 1, so that the Si material 1 is heated locally.

The rotatable arm 5 includes a clamping or holding portion 5*b* supported on a rail 6 so as to be rotatable around a rotary shaft 5*a*. The holding portion 5*b* is made of the same material as the Si material 1 or a material having a hardness higher than the Si material. The rotary shaft 5*a* has its axis in a direction perpendicular to the axial direction of the rod-like Si material 1 being fed by the guide roller group 3. Then, the heated Si material 1 is fed so that the axial direction thereof follows a circular-arc orbit guided by the holding portion 5*b*. While the Si material 1 is held by the holding portion 5*b*, the rotatable arm 5 is pushed by the Si material 1, and then, is rotated, and thereby, continuously applies a bending moment to the heated portion of the Si material 1. As described above, the heated portion of the Si material 1 is in a state in which a slip is easy to generate between lattices or between crystal grains, so that a slip is generated by the applied bending moment. As a result, a bend is formed in the Si material 1.

According to the bending method as described above, it is possible to carry out so-called continuous dieless bending without the use of molding dies, and to bend the rod-like Si material 1 into a gentle circular-arc shape. Moreover, since no molding dies are used, the heated portion of the Si material 1 has no contact with the surface of a molding die. Therefore, the bending is performed in a manner which reduces or eliminates contamination such as metal pollution, oxidation or the like from contact with molding dies.

Referring to FIG. 2, the above bending method produces a constant bending accuracy. First, in the above machining system, a bending moment is uniquely applied only to the front side from a bending fulcrum with respect to the traveling direction of the Si material 1. In general, according to bending for a steel pipe, a workpiece has a temperature distribution with respect to the traveling direction thereof controlled by water cooling (quenching). Even if a bending moment is uniquely applied only to the front side from a bending fulcrum with respect to the traveling direction of the workpiece, a deformation is generated only in portions having no cooling, and thereby, bending accuracy is kept constant. On the other hand, in bending a brittle material such as Si material 1, the cause relied on for deformation is mainly a slip between crystals. When slip deformation is generated, a generated bending moment is absorbed by a feed of the guide roller group 3 and by a rotation of the rotatable arm 5. According to the above bending method, by continuously feeding the Si material 1, a bending moment is continuously applied to the Si material 1. As a consequence, a process is performed in which the generation of a slip deformation is continuously repeated. Thus, bending is performed without dispersion by a self-adjustment operation.

In order to feed the Si material 1, a thrust force (propulsion) is applied to the Si material 1 from the pressure cylinder of a driving system 2, and a traction force may be applied to the Si material 1 by rotating and driving the rotatable arm 5.

The Si material 1 is locally heated directly after the Si material 1 is fed from the guide roller group 3. Thereby a heated region in the Si material 1 is successively moved with the feed of the Si material 1 and a gentle temperature distribution is given to the Si material 1. Therefore, by carrying out the aforesaid continuous dieless bending, the Si material 1 is deformed while absorbing heat impact. Then, the deformed portion is gradually enlarged, and thus, a predetermined bending portion is realized, so that preferable bending is performed.

In the heated region of the Si material 1, the highest temperature region is situated to the rear, or upstream side, of a bending fulcrum with respect to the traveling direction of the Si material 1, and thereby, preferable bending is performed.

The holding portion 5*b* is made of the same material as the Si material 1 or a material having a hardness greater than the Si material 1. Therefore, bending is performed while reducing contamination such as metal pollution, oxidation or the like.

The type of heater is not limited to the above heater 4 using high-frequency heating. Instead, radiant heating, using a gas burner or high frequency, may be used. If the heating temperature is set about 900° C. or more, preferable bending is performed, and more preferably, the heating temperature is set about 1300° C. or less in view of limiting the aforesaid contamination.

Figures 3, 3A:
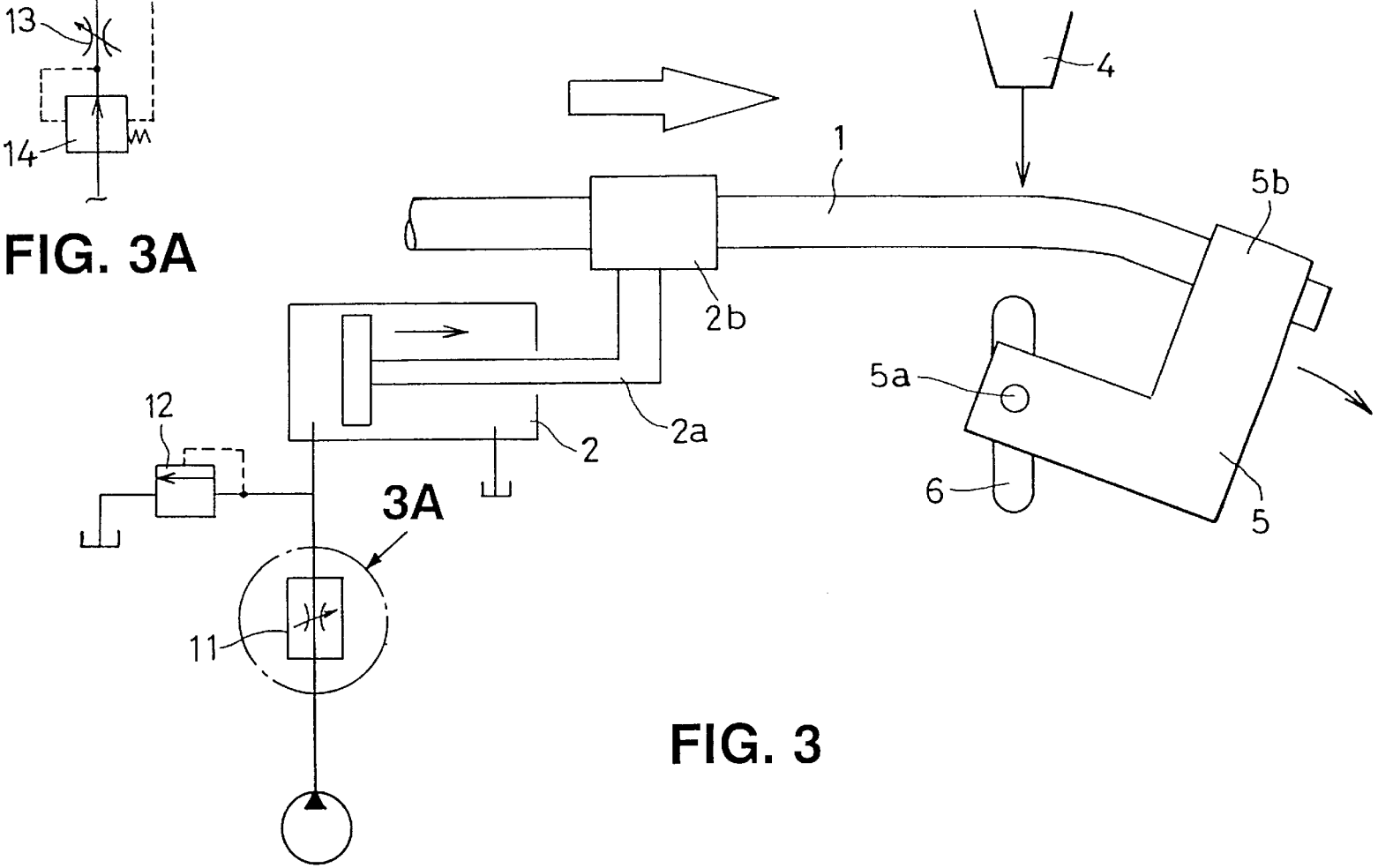
FIGS. 3 and 3*a* are views schematically showing a modified example of the machining system for carrying out a bending method of the present invention.

Referring now to FIGS. 3 and 3*a*, a thrust force (propulsion) is applied to a rod-like Si material 1 in an axial direction of the material 1 by a hydraulic cylinder 2 used as a diving device (actuator). The rod-like Si material is fed in a specific direction. More specifically, a rod 2*a* of the hydraulic cylinder 2 includes a holding (retaining) portion 2*b*. The rod-like Si material is held by the holding portion 2*b*. A rotatable arm 5, including a holding portion 5*b*, is supported on a rail 6 so as to be freely rotatable around a rotary shaft 5*a*. The holding portion 5*b* is made of the same material as the Si material 1 or a material having a hardness higher than the Si material. An axis of the rotary shaft 5*a* is perpendicular to the axial direction of the rod-like Si material fed by the hydraulic cylinder 2. A heater 4 is disposed at a position where the rod-like Si material 1 thus fed runs on a circular-arc orbit of the holding portion 5*b*, or on the neighborhood position. The heater 4 may be a hydrogen-oxygen mixed gas burner, for example. The Si material 1 is heated by the heater 4. The heated Si material 1 is fed with its axial direction running along the circular-arc orbit of the holding portion 5*b*. With the Si material 1 held by the holding portion 5*b*, the rotatable arm 5 is pressed by the Si material 1, and thereby is rotated. In this manner, a bending moment is continuously applied to a heated portion of the Si material 1. The heated portion of the Si material 1 is in a state in which a slip is easy to generate between its lattices or between its crystal grains. For this reason, a slip is generated in the Si material by the applied bending moment; as a result, a bend is generated therein.

The above bending machine is controlled so that a flow rate of hydraulic oil supplied to the hydraulic cylinder 2 remains approximately constant. The highest (maximum) pressure is previously set so that an internal pressure of the hydraulic cylinder 2 does not exceed a reference value. More specifically, as shown in FIGS. 3 and 3*a*, a pressure compensating type flow regulating valve 11 and a relief valve 12 are located ahead of the hydraulic cylinder 2. The pressure compensating type flow regulating valve 11 is composed of a variable orifice 13 and a fixed differential pressure type pressure reducing valve 14. The front-position fluid pressure of the variable orifice 13 is introduced into a pilot chamber of the pressure reducing valve 14. The rear-position fluid pressure of the variable orifice 13 is introduced into a spring chamber of the pressure reducing valve 14. A differential pressure between front and rear positions of the variable orifice 13 is maintained at a pressure controlled by a spring force. Thus, even if the fluid pressure varies, the flow rate of fluid flowing through the variable orifice 13 remains constant. Also, the relief valve 12 is actuated (operated) so that a fluid pressure of the hydraulic cylinder 2 does not exceed a reference pressure. In the bending method, the rotatable arm 5 is supported so as to be freely rotatable.

Figure 4:
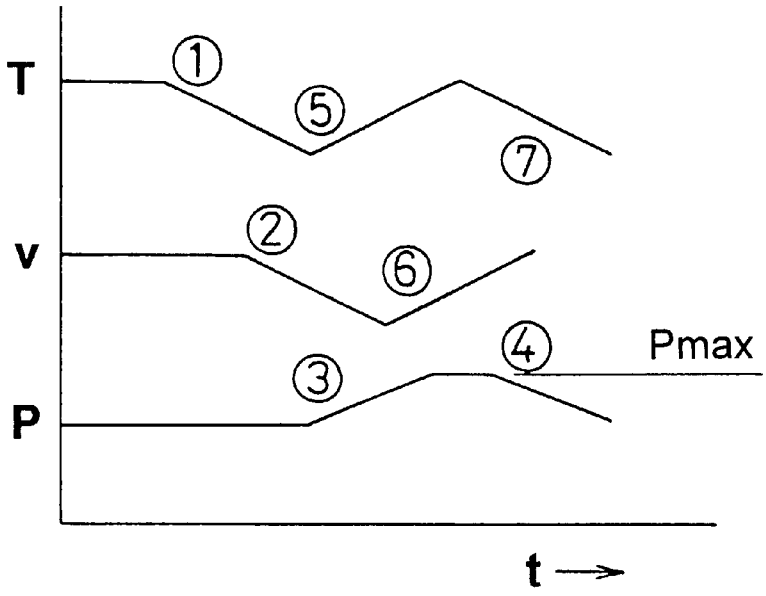
FIG. 4 is a time chart showing elapsed changes of a temperature T of the heated portion in a bending operation of Si material, a feed speed V of the rod-like Si material 1, and an internal fluid pressure P of a hydraulic cylinder 2 wherein the fluid flow rate is held constant.
Figure 5:
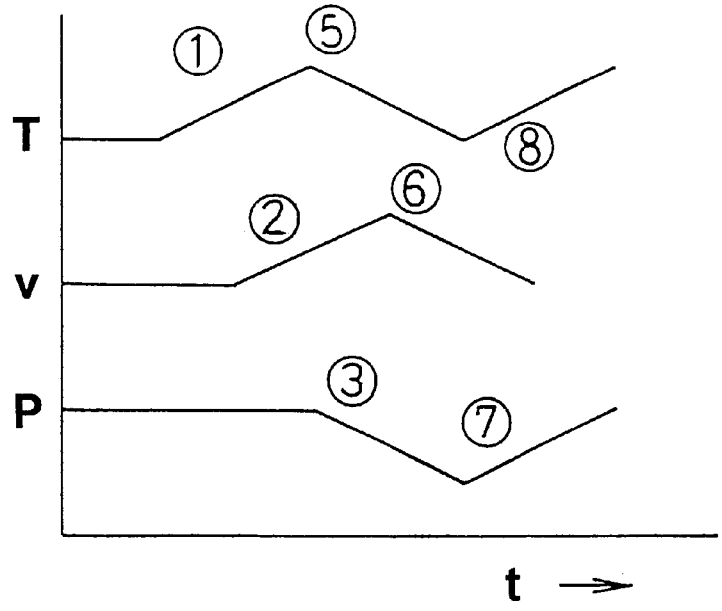
FIG. 5 is a time chart showing elapsed changes of a temperature T of the heated portion in a bending operation of Si material, a feed speed V of the rod-like Si material 1, and an internal fluid pressure P of a hydraulic cylinder 2 wherein the fluid flow rate is held constant.

Referring now to FIGS. 4 and 5, the following is a description of a bending operation of the Si material in the case of using the aforesaid bending machine. That is, the bending machine is controlled so that a flow rate of the fluid supplied to the hydraulic cylinder 2 remains constant. The drawings show the elapsed changes of a temperature T of the heated portion in a bending operation, a feed speed v of the rod-like Si material 1, and an internal fluid pressure P of the hydraulic cylinder 2. First, as shown in FIG. 4, when the temperature T of the heated portion of the Si material 1 is lowered due to any factors (disturbance) (time 1), a deformation resistance of the Si material 1 increases. Also, a feed rate of the hydraulic cylinder 2 is reduced while the feed speed v of the Si material 1 decreases (time 2). As a result, the internal fluid pressure p in the hydraulic cylinder 2 increases (time 3). The highest (maximum) internal pressure of the hydraulic cylinder 2 is regulated by the aforesaid relief valve 12. This prevents bending and breaking of the rod-like Si material 1 by an abnormal increase in pressure (time 4). As described above, when the feed speed v of the Si material 1 decreases, the residence time of the Si material at the heated portion increases. As a result, the amount of heat applied to the Si material also increases. The temperature T of the Si material in the heated portion increases (time 5). Whereupon a deformation resistance of the Si material 1 is reduced while the internal fluid pressure P of the hydraulic cylinder 2 increases. The increased temperature increases the slip deformation generated in the Si material 1. As a result, the Si material 1 is bent and deformed, and the feed speed v of the Si material 1 is increased (time 6). Thereafter, the internal fluid pressure P of the hydraulic cylinder 2 is reduced (time 4). Then, the feed speed v of the Si material 1 is increased. As a result, the residence time of the Si material 1 in the heated portion is reduced. The amount of heat absorbed by the Si material consequently is reduced. For this reason, the temperature T lowers (time 7), and thereafter, the same operation as described above is repeated. According to the above bending method, as seen from the above description, the following sequence occurs:

1) the temperature decreases T1,
2) deformation resistance increases
3) the feed speed decreases T2
4) the temperature increases T5
5) the deformation resistance decreases
6) the feed speed increases T6
7) the temperature decreases T7
8) etc.

The above procedure is repeated in a feedback manner to provide smooth automatic bending.

Referring to FIG. 5, conversely, when the temperature T of the heated portion of the Si material 1 rises due to any factor (disturbance) (time 1), the deformation resistance of the Si material 1 is reduced while the feed rate of the hydraulic cylinder 2 is increased. As a result, the feed speed v of the Si material 1 is increased (time 2). Then, the internal fluid pressure p of the hydraulic cylinder 2 is reduced by the increase in feed rate (time 3). As described above, when the feed speed v of the Si material 1 increases, the residence time of the Si material in the heated portion is shortened. This reduces the quantity of heat absorbed by the Si material. This lowers the temperature T of the Si material (time 5). Whereupon the deformation resistance of the Si material 1 increases while the feed speed v of the Si material 1 decreases (time 6). Thereafter, the internal fluid pressure P of the hydraulic cylinder 2 increases (time 7). Then, the feed speed v of the Si material 1 decreases. As a result, the residence time of the Si material in the heated portion increases, and the amount of heat absorbed increases. For this reason, the temperature T increases (time 8), and thereafter, the same operation as described above is repeated.

According to the above bending method, as seen from the above description, the following operations occur in sequence:

1) the temperature increases T1
2) the deformation resistance decreases
3) the feeding speed increases T2
4) the temperature of the Si material decreases T5
5) the deformation resistance increases
6) the feed speed decreases T6
7) the temperature of the Si material increases T8
8) etc.

In this manner, bending is smoothly carried out.

On the contrary, in FIG. 6, if the feed speed v is held constant, the negative feedback in the above preferred embodiment is not accomplished. First, as shown in FIG. 6, when the temperature T of the heated portion is reduced due to any factor (disturbance) (time 1), the deformation resistance of the Si material 1 increases due to the decrease in temperature of the Si material. Since the feed speed V of the Si material 1 is constant, the internal fluid pressure P of the hydraulic cylinder 2 increases (time 2). Then, bending deformation becomes more difficult due to an increase in the deformation resistance of the Si material 1. As a result, the internal fluid pressure P of the hydraulic cylinder 2 gradually increases. Finally bending and breakage of the Si material 1 occurs (time 3).

As described above, by maintaining the flow rate of the fluid supplied to the hydraulic cylinder 2 constant, a bending deformation is generated when the temperature change of the heated portion of the Si material 1 and the feed speed V of the Si material 1 are well-matched. That is, bending proceeds under an operating condition of self-regulation operation as described in the following:

1) the temperature change causes the deformation resistance change
2) the deformation resistance change brings about a bending deformation quantity change
3) the change in the bending deformation quantity changes the feed speed.
4) the change in the feed speed again causes the temperature change.

As a result, stable bending is carried out.

An air cylinder may be substituted for the hydraulic cylinder 2 without departing from the spirit and scope of the invention. When using an air cylinder flow rate control is also carried out as described above.

When the above-mentioned bending is carried out, the temperature of the heated portion is an important regulation factor. At the same time, the strain velocity applied to the Si material 1 in the bending operation is also an important factor for determining the success or failure of the bending operation.

Referring to FIG. 7, the relationship is shown between a temperature dependency of a yield stress (upper yield stress) of the Si material 1 [see J. R. Patel and A. R. Chaudhuri; J Appl. Phys. 34, 2788 (1966)]. As shown in FIG. 7, when the heating temperature increases, the yield stress is reduced, and at the same time, the yield stress is also reduced when the strain velocity decreases. Now directing notice to a case of the strain velocity of $1.1\times10^{-3}$/sec., when the heating temperature reaches the vicinity of about 1200° C., the Si material 1 yields at a stress of about 10 MPa. Assuming a state that an Si rod having a diameter of 8 mm is bent into a circular-arc shape having a radius of 50 mm over an angle of only 90°, a strain generated at the rod inner and outer diameter is simply calculated to be about =0.08. When such a strain quantity is fed at the strain velocity of $1.1\times10^{-3}$/sec., about 72 seconds is required to complete the bend. Therefore, the Si rod is fed at a speed of about 1 mm/sec. Applying this condition to a case of the strain velocity of $1.1\times10^{4}$/sec., controlling the feed speed of the Si rod to be about 0.1 mm/sec., and the heating temperature to be 1000–1100° C., bending of the Si rod is carried out. From the above result, it is obviously favorable to carry out the bending operation of the Si material 1 with the heating temperature of 900–1300° C., preferably 1000–1250° C. from a viewpoint of reducing contamination, and at the strain velocity of $1.1\times10^{-3}$/sec. to $1.1\times10^{-4}$/sec. (about $10^{-3}$~$10^{-4}$/sec.) from a viewpoint of the bending workability, in addition to considering the melting point of Si (1410° C.).

EXPERIMENTAL EXAMPLES

EXAMPLE 1

With the use of the machining system as shown in FIGS. 3 and 3*a*, a single crystal Si rod having a diameter of 8 mm was heated to about 1250° C. by a gas burner while being fed at a speed of 0.5–0.7 mm/sec and then, was bent into a circular-arc shape having a bending angle of 90 and a radius of 50 mm while a thrust force (propulsion) of 11.5 kg being applied thereto. Ten (10) Si rods were subjected to bending; as a result, an error in the bending angle was 90±1.5 and in the radius was 50 mm ±1.5 mm, and no breakage (fracture) was generated therein.

Figure 8A:
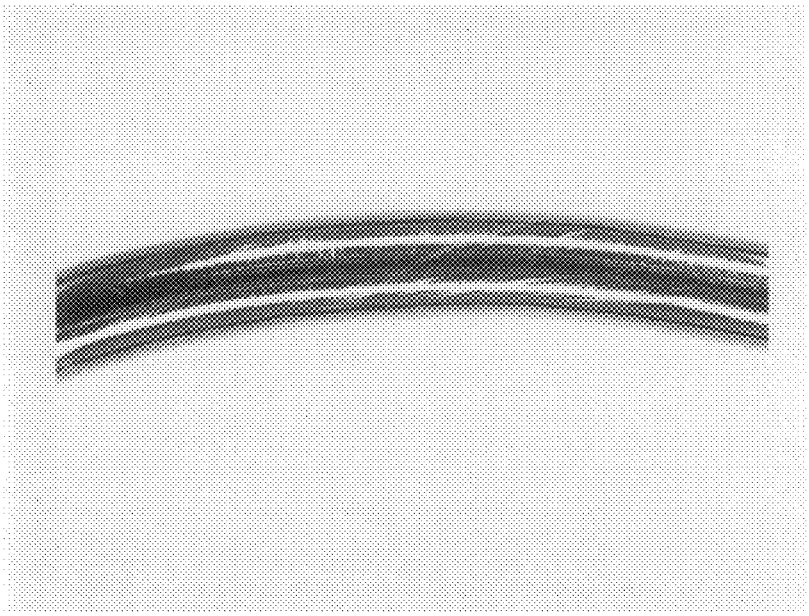
FIG. 8*a* is a photograph showing an appearance of bent rod-like Si material.

Referring now to FIG. 8*a*, the SEM micrograph shows the appearance of the bent rod-like Si material and a SEM microphotograph of the fractured surface and the periphery surface of the bent rod-like Si material.

Figure 8B:
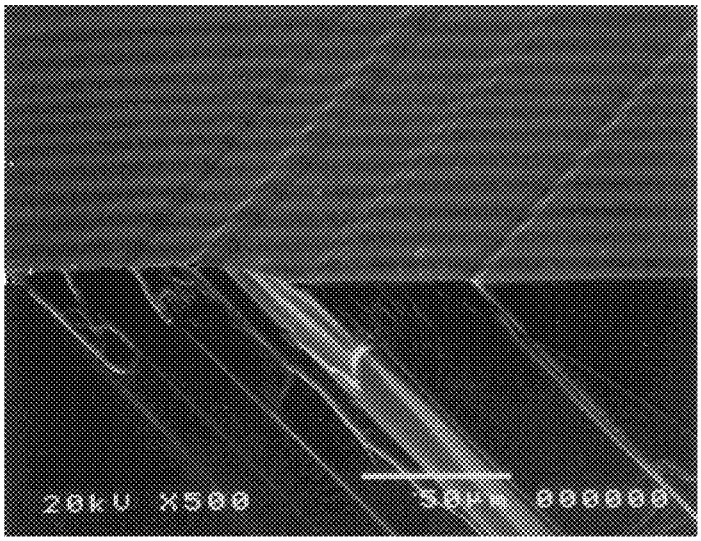
FIG. 8*b* is a SEM micrograph of the fractured surface and periphery surface of a bent Si rod.

Referring now to FIG. 8*b*, the upper portion of the SEM microphotograph shows the peripheral surface of the bent rod-like Si material, and the lower portion: shows the fractured surface. Slip lines can be clearly seen.

EXAMPLE 2

A single crystal Si rod having a diameter of 8 mm was bent into a circular-arc shape over a bending angle of 90 and a radius of 100 mm under the same machining condition as the above Example 1. Ten (10) Si rods were subjected to bending; as a result, an error in the bending angle was 90+1.5 and that in the radius was 100 mm±2 mm, and no breakage (fracture) was generated therein.

Figure 9:
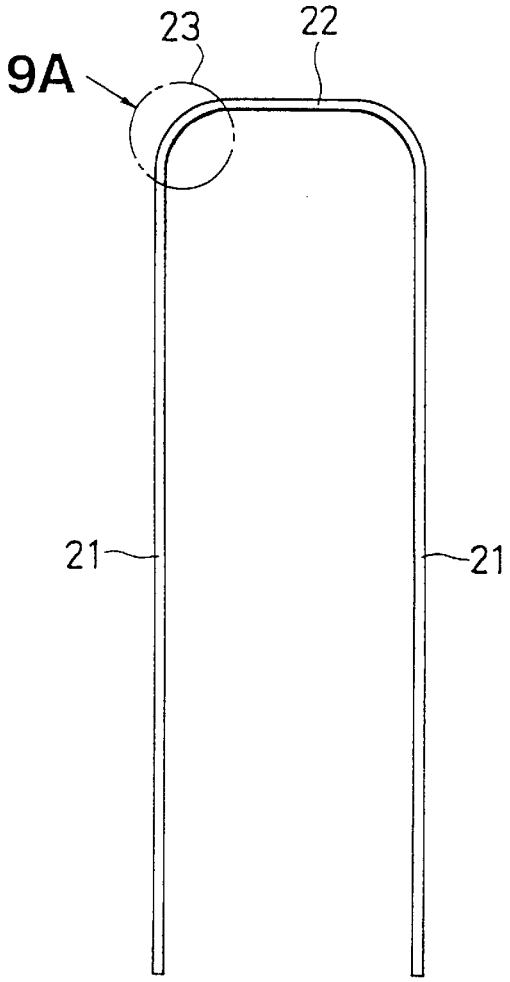
FIGS. 9 and 9*a* are views schematically showing one embodiment of a core wire member made of Si material according to the present invention.
Figure 9A:
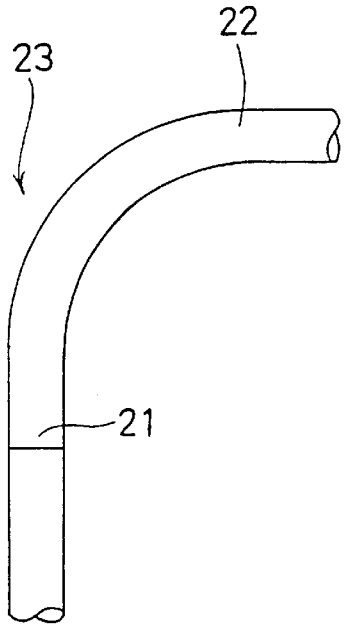
Figure 10:
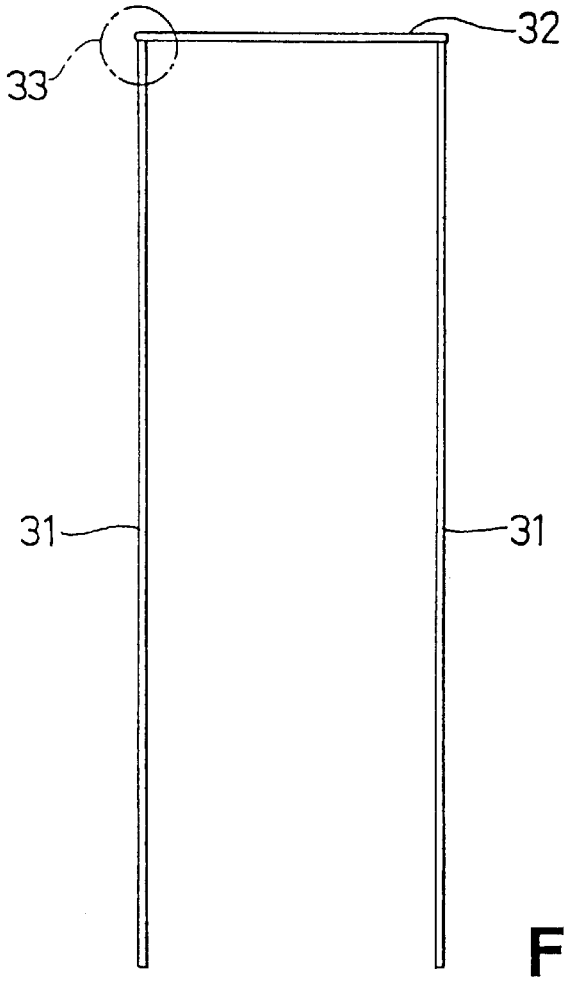
FIG. 10 is a view schematically explaining a structure of the conventional core wire member made of Si material.
Figure 11:
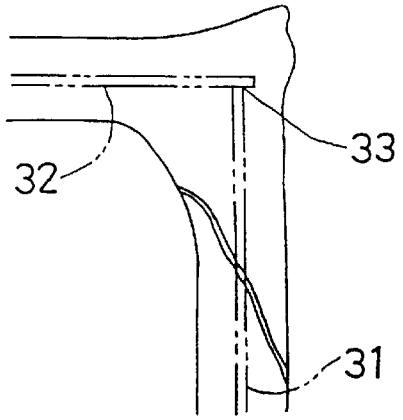
FIG. 11 is a view schematically explaining disadvantages occurring in a polycrystal Si-rod manufactured by the conventional core wire member made of Si material.

Next, the preferred application example of a binding method for Si material of the present invention will be described below. This is a trial to manufacture a core wire member made of S-based material for manufacturing a polycrystal Si by the above method. That is, a joint 23 extending from the core wire portion 21 to the connective portion 22 is formed by bending. And at the same time, the core wire member made of Si material is made by connecting the rod-like Si material using electron beam welding, laser welding, or mechanical joining method and the like. This core wire member made of Si material, as shown in FIGS. 9 and 9*a*, consists of a pair of core wire portion 21, 21 extending substantially parallel with each other, a connective portion 22 connecting one end side of core wire portion 21, 21, each joint 23 extending from the core wire portion 21 to the connective portion 22 being formed by bending. In the joint 23, abnormal growth of the polycrystal Si is unlikely to occur, so that bending and cracking the rod-like polycrystal Si is readily carried out. As a result, it is possible to improve a manufacture yield of the rod-like polycrystal Si.

The core wire member made of Si material for manufacturing the polycrystal Si may be manufactured utilizing other bending methods in addition to the above-mentioned bending method, so long as the same effect is obtained.

The present invention is not limited to rod-like Si materials having circular cross sections. For example, Si materials having an ovoid or rectangular cross section are equally subject to bending using the techniques of the present invention. In addition, besides bending in the shape of circular arcs, the present invention is capable of bending Si materials in other shapes such as, for example, in S turns or in a plurality of turns separated by straight sections.

The above, and other objects, features and advantages of the present invention will become apparent from the following description read in conjunction with the accompanying drawings, in which like reference numerals designate the same elements.

What is claimed is:

1. A bending method for Si material, comprising the following steps of:

heating an Si material to at least a brittle-ductile transition temperature to produce a heated portion;

feeding said Si material past said heating;

applying a bending moment to said heated portion to produce a slip deformation in said Si material; and stabilizing said applying of said bending moment using negative feedback, wherein said negative feedback comprises the steps of:

slowing said feeding in response to an increase of said temperature; and increasing said feeding in response to a decrease of said temperature.

2. The bending method for Si material according to claim 1, wherein the step of applying a bending moment includes:

holding a portion of said Si material on a rotatable arm located downstream of said heating; and feeding said Si material past said heating toward said rotatable arm, thereby urging said rotatable arm to rotate in a generally circular arc, thereby applying a. bending moment to said Si material.

3. The bending method for Si material according to claim 2, wherein the step of feeding includes applying a thrust force to said Si material.

4. The bending method for Si material according to claim 3, wherein the step of feeding further includes applying a traction force on said rotatable arm.

5. The bending method for Si material according to claim 2, wherein the step of feeding includes applying a traction force on said rotatable arm.

6. The bending method for Si material according to claim 1 wherein said Si material comprises a shape, wherein said shape is rod-like.

7. The bending method for Si material according to claim 2, wherein the step of heating includes locally heating said Si material in proximity to a location downstream of said feeding, whereby a heated region of said Si material moves along said Si material as said Si material is fed.

8. A method according to claim 1, wherein the step of heating is effective for locally heating said Si material to a temperature of from about 900 to about 1300° C.

9. A method according to claim 8, wherein said temperature is from about 1000 to about 1250° C.

10. A method according to claim 2, wherein:

the step of heating includes heating said Si material upstream of a location where said holding is performed; and the step of feeding includes applying a force from a fluid cylinder to said Si material, and feeding a substantially constant flow of fluid to said fluid cylinder.

11. A method according to claim 1, wherein the step of heating is effective for locally heating said Si material to a temperature of less than 1180° C.

12. A method according to claim 1, wherein the step of heating is effective for locally heating said Si material to a temperature of about 1000° C. to about 1100° C. and wherein said step of feeding said Si material is less than 2 mmu /sec.

* * * * *